United States Patent [19]

Owen

[11] Patent Number: 4,867,714

[45] Date of Patent: Sep. 19, 1989

[54] PIN AND SOCKET TERMINAL

[75] Inventor: Leonard J. Owen, Watford, Great Britain

[73] Assignee: AMP Incorporated, Harrisburg, Pa.

[21] Appl. No.: 295,408

[22] Filed: Jan. 10, 1989

[30] Foreign Application Priority Data

Jan. 27, 1988 [GB] United Kingdom ..... 8801742

[51] Int. Cl.[4] ..... H01R 13/54

[52] U.S. Cl. ..... 439/848

[58] Field of Search ..... 439/848, 851, 852, 856, 439/857, 861, 862

[56] References Cited

U.S. PATENT DOCUMENTS

| | | | |
|---|---|---|---|
| 3,163,485 | 12/1964 | Kruitwagen | 339/272 |
| 3,189,868 | 6/1965 | Hatfield | 339/252 |
| 3,409,866 | 11/1968 | Roggeveen | 339/256 |
| 3,546,665 | 12/1970 | Zak | 439/848 |
| 3,829,820 | 8/1974 | Hubner et al. | 439/848 |

*Primary Examiner*—Joseph H. McGlynn
*Attorney, Agent, or Firm*—Bruce J. Wolstoncroft

[57] ABSTRACT

A pin and socket terminal is comprised of a pin (2) and a socket (4). The socket (4) has a lead-in portion (3) which is an integral portion of housing (21). The lead-in portion (3) cooperates with the pin (2), as the pin is inserted into the socket, such that the rotation of the pin is controlled as insertion occurs. In order to accomplish this controlled rotation, the lance (12) physically engages camming surfaces (34) of the socket (4) as the pin (2) is inserted into the socket (4). The configuration of the camming surfaces (34) insures that the lance (12) and the pin (2) will be prevented from harmful rotation, which is particularly important when the pin is electrically connected to a fine wire. The cooperation of the lance (12) and a respective slot (28) of the socket (2) also insures that the pin (12) will be prevented from any movement relative to the socket when the pin is fully inserted into the socket.

10 Claims, 2 Drawing Sheets

PIN AND SOCKET TERMINAL

FIELD OF THE INVENTION

The present invention relates to a pin and socket arrangement, and in particular to a pin and socket which cooperate to prevent damaging rotation of the pin as the pin is inserted into the socket.

BACKGROUND OF THE INVENTION

Pin and socket terminals are well known in the electrical field and have been used to provide electrical connections for numerous types of electrical equipment, appliances, computers, systems, etc. Electrical terminals of the prior art contain various teachings of lance configurations for retaining terminals within insulating members. The primary considerations in the design of retaining lances has been that the lances have sufficient strength to withstand normal pull out requirements and that they be sufficiently protected to minimize the possibility of being over-stressed during handling of the terminal prior to insertion within a housing. However, with the trend toward miniaturization, another consideration has arisen. The lances must cooperate with the sockets, or some part of the housing surrounding the sockets, in such a way as to prevent the rotation of the pins as they are inserted into the sockets.

Minimizing the rotation of each of the pins during insertion into respective sockets is of importance for many applications, however, minimal rotation of the pin becomes increasingly important when very fine wire is attached to the pin terminals. If the insertion of the pins is not controlled, the rotation of the pins will cause the fine, fragile wire to be damaged. This results in the destruction of the electrical connection between the pin and the wire, resulting in the failure of the system.

SUMMARY OF THE INVENTION

An object of this invention is to provide a pin and socket which cooperate to prevent the rotation of the pin as the pin is inserted into the socket. Consequently, the pin and socket configuration can be used with fine wires.

Another object of the present invention is to provide a pin and socket arrangement in which the pin is prevented from movement relative to the socket when the pin and socket are in operation.

In accordance with the present invention an electrical connector for use with a pin contact is disclosed. The electrical connector is comprised of an electrical terminal and a dielectric housing. The terminal has a contact engaging section for electrical engagement with the pin contact. The dielectric housing is provided with a contact receiving cavity extending therethrough to the mating surface of the dielectric housing. The terminal is positioned in a portion of the contact receiving cavity.

The electrical connector is characterized in that the cavity has lead-in and securing surfaces which extend radially inwardly proximate the mating surface. The surfaces are spaced apart and separated by a plurality of camming slots and securing slots. The slots being positioned symmetrically about the circumference of the cavity. The cavity is adapted to receive a pin contact having means which are cooperable with the camming slots to prevent over rotation of the pin contact during insertion into the contact receiving cavity. The pin contact means also cooperates with the securing slots to prevent any type of movement of the pin contact after the pin contact has been fully inserted into the contact receiving cavity.

DETAILED DESCRIPTION OF THE INVENTION

Figure 1:
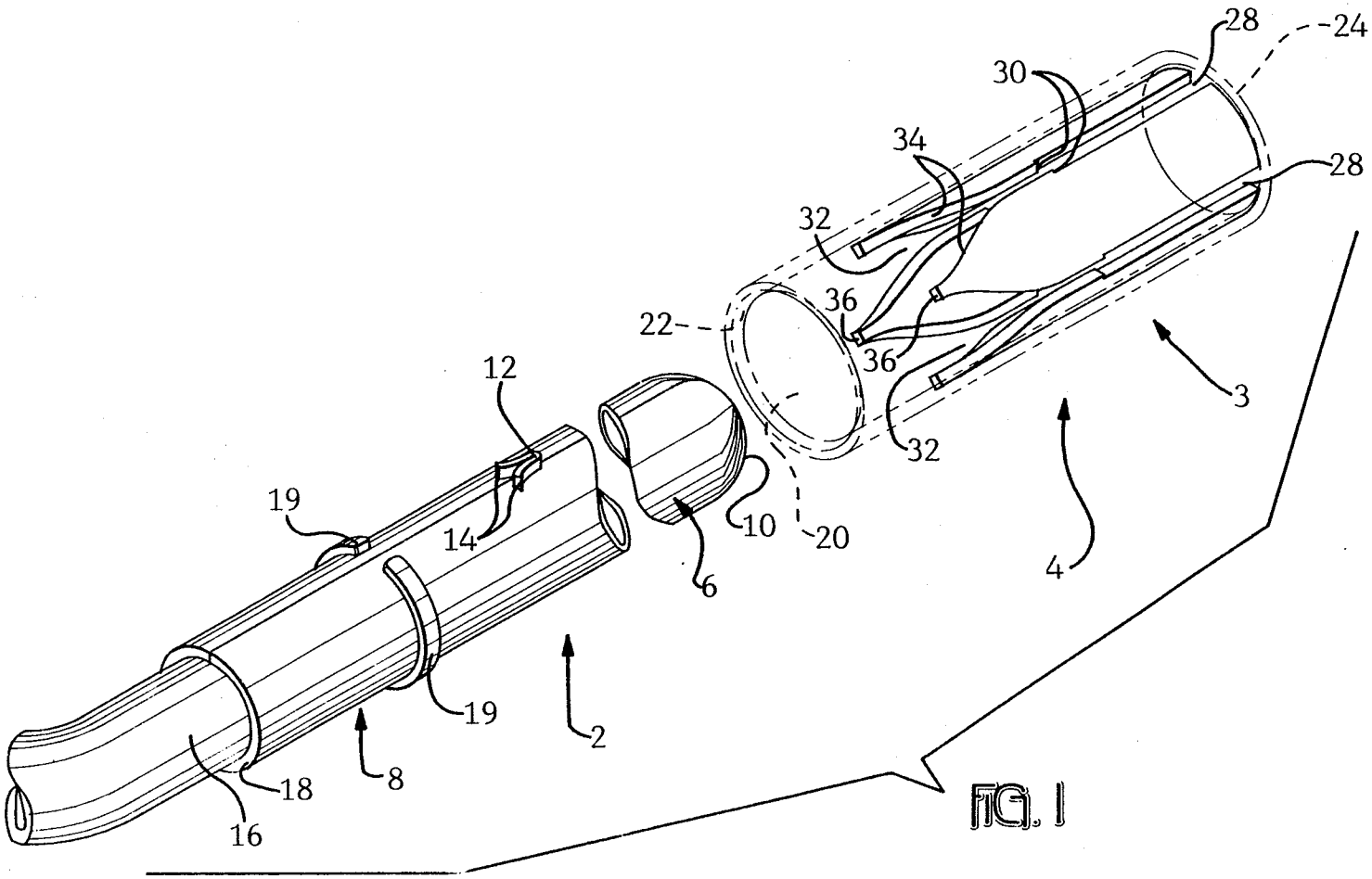
FIG. 1 is a three dimensional view of the pin and socket of the present invention.

With reference to FIG. 1, there is shown an electrical pin terminal 2 and a socket 4 according to the present invention. The pin 2 is matable with the socket 4 as will be more fully discussed below. Socket 4 has a molded lead-in and retention portion 3 and a terminal portion 5 which contains a terminal 7 therein. Both pin 2 and terminal 7 are stamped and formed of material having the conductive characteristics required to insure that a positive electrical connection is effected.

Pin 2, as shown in FIG. I, has a front portion 6 and a rear portion 8. Front portion 6 has an essentially cylindrical configuration, with the outside surfaces of front portion 6 acting as the contact surfaces when pin 2 is mated with socket 4. A leading edge 10 of front portion 6 has an arcuate surface, thereby insuring that pin 2 will be properly inserted into socket 4, as will be discussed. When pin 2 is fully inserted into socket 4, front portion 6 extends from lead-in portion 3 to cooperate with terminal 7 of socket 4, thereby providing the electrical path required for operation.

Lance 12 is provided on the outside surface of rear portion 8 of pin 2. Lance 12 is positioned on rear portion 8 proximate front portion 6. As best shown in FIG. 1, lance 12 projects outward from outside surface of pin 2. Lance 12 is V-shaped, with the point of the V pointing in the direction of insertion of pin 2 into socket 4. Resilient end portions 14 of lance 12 act as shoulders, as will be discussed. The resiliency of end portions 14 is due to the fact that lances 12 are integral with rear portion 8 at the point of lance 12. End portions I4 are not attached to rear portion 8 of pin 2.

Rear portion 8 of pin 2 is also cylindrical in shape. A wire 16 extends from a rear edge 18 of rear portion 8. Wire 16 is electrically engaged and secured to pin 2 by crimping or other similar method. It should be noted that many different configurations of rear portion 8 are well known and could easily be applied to pin 2.

Shoulder projections 19 extend circumferentially about rear portion 8 of pin 2. Projections 19 extend outward from rear portion 8 approximately the same distance as lance 12 extends from rear portion 8 of pin 2.

Socket 4 has a generally cylindrical inner configuration. Lead-in portion 3 of socket 2 is molded from the same dielectric material as housing 21 which surrounds an opening 20. Portion 3 is configured such that the inside surface of opening 20 has a greater diameter than the diameter of pin 2. Opening 20 extends through lead-in portion from a first end 22 to a second end 24. The diameter of the opening 20 proximate end 22 is greater than the diameter of opening 20 proximate end 24. This configuration allows for a greater tolerance as pin 2 is inserted into first end 22, thereby allowing for easy insertion of misaligned pins into lead-in portion 3 of socket 4. Sloping surfaces 26 of lead-in portion 3 provide the transition between the large diameter proximate end 22 and the smaller diameter proximate end 24.

Figure 4:
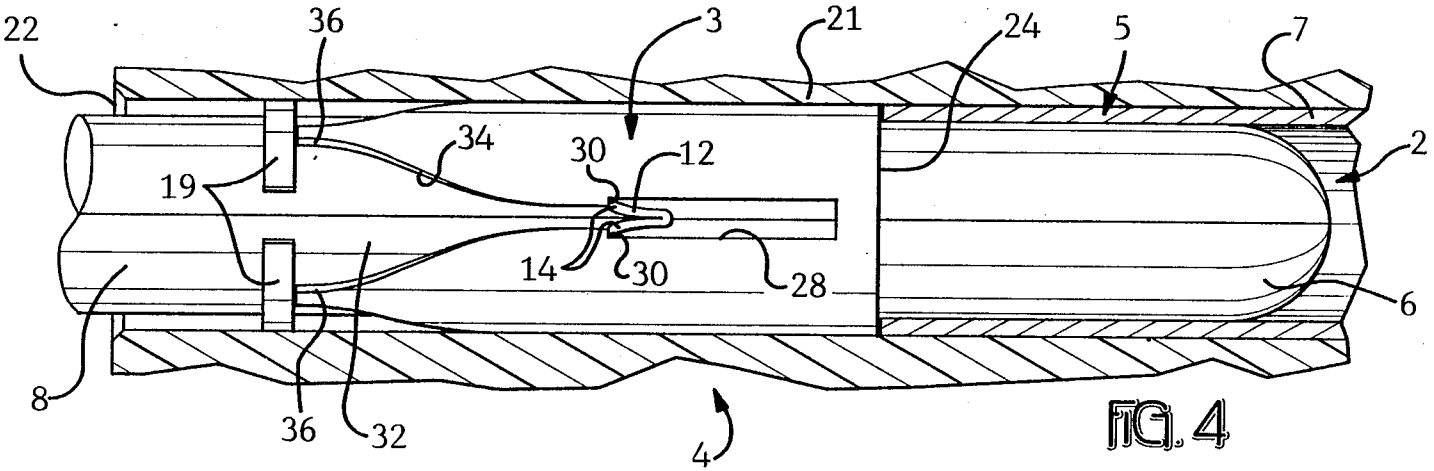
FIG. 4 is a cross-sectional view, similar to that of FIG. 3, showing the pin fully inserted into the socket.
Figure 3:
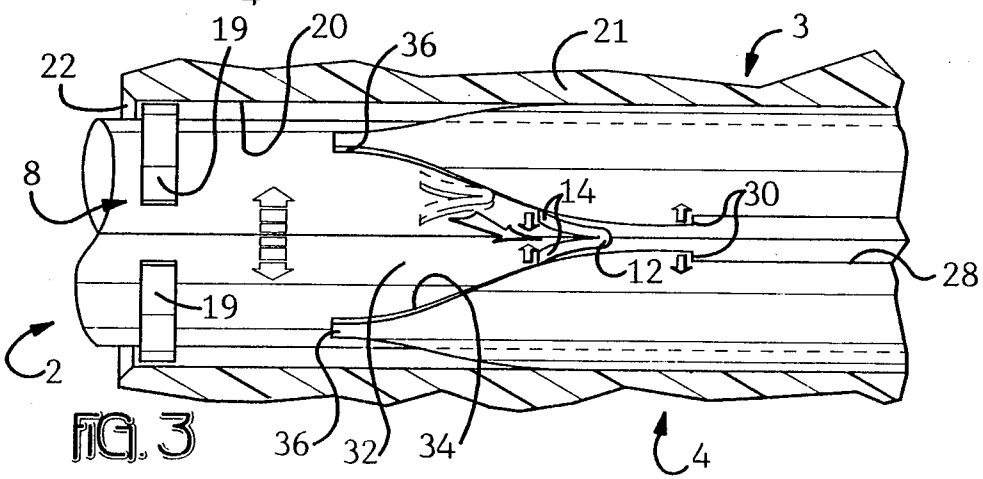
FIG. 3 is a cross-sectional view of the pin and socket, as the pin is being inserted into the socket.
Figure 2:
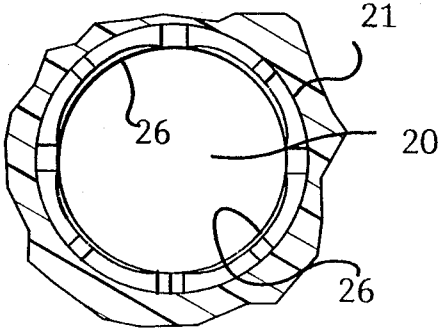
FIG. 2 is a plan view of the socket as viewed from a leading end thereof.

Slots 28 are provided in the surface of opening 20 proximate second end 24. For ease of explanation and understanding, only one slot will be described in detail. However, the detailed description of one slot applies to all slots, as all slots are identical. As best shown in FIGS. 3 and 4, the width of slot 28 is equal to or slightly greater than the width of projection 12 of pin 2. An end of each slot 28 which is positioned nearest first end 22 has a pair of shoulders 30 which extend toward each other. Shoulders 30 are not in engagement with each other as a camming slot 32 extends therebetween, separating shoulders 30 from each other.

Camming slot 32 extends from shoulders 30 toward first end 22 of socket 4. As is shown in FIG. 1, camming surfaces 34 are positioned on either side of camming slot 32. The configuration of slot 32 is essentially that of a large V, with the wide portion of the V being positioned toward first end 22 of socket 4. The number of camming slots 32 which are provided about opening 20 are equal to the number of slots 28.

The number of slots 28 and camming slots 32 provided about the circumference of the inner surface of lead-in portion 3 of socket 4 may vary according to the requirements of the particular pin and socket. However, the number of slots 28 will always be equivalent to the number of camming slots 32. The overall size of each camming slot 32 is directly dependent upon the number of camming slots 32 provided. No matter the number of camming slots 32 provided, the camming surfaces 34 of adjacent camming slots 32 will always cooperate to form points 36 along the surface of opening 20 proximate end 22. This configuration is best illustrated in FIG. 1. It must be noted that the number of points 36 provided will vary according to the number of slots 28, 32 required for operation. For example if four slots are required, four points will be provided, etc.

In operation, front portion 6 of pin 2 is inserted into opening 20 of socket 4. As this occurs arcuate leading edge 10 of pin 2 is positioned in wide portion of opening 20. Opening 20 has the wide portion provided to allow pin 2 to be easily inserted into socket 4. In other words, if pin 2 is slightly bent, or not directly in line with the longitudinal axis of socket 4, pin 2 will enter opening 20 due to the large tolerance level provided by the side opening. Consequently, the wider portion of opening 20 allows for insertion of imperfect pin 2 into socket 4.

As insertion continues arcuate leading edge 10 of pin 2 contacts one or more lead-in surfaces 26 of lead-in portion 3 of socket 4. The lead-in surfaces 26 cooperate with leading edge 10 of pin 2 to force pin 2 into the narrow portion of opening 20. This insures that as insertion continues, the longitudinal axis of pin 2 will coincide with the longitudinal axis of socket 4. Consequently, as front portion 6 of pin 2 is inserted into terminal 7 of socket 4, a positive electrical connection is effected due to the proper alignment of pin 2 with respect to terminal 7.

As insertion occurs, it is important that pin 2 not be allowed to rotate in socket 4. This is extremely important when fine wire is being used. When fine wire is attached to pin 2 even the slightest rotation of pin 2 in socket 4 will cause a failure of the fragile wire. This is not an acceptable result. Therefore, in order to prevent this type of rotation of pin 2 in socket 4, projection 12 of pin 2 cooperates with camming slots 32 and slots 28 of socket 4.

As insertion occurs, lance 12 is positioned in opening 20 of lead-in surface 3 of socket 4. As pin 2 advances toward terminal 7, lance 12 is advanced into a respective camming slot 32. This result is insured no matter how pin 2 is inserted into socket 4, as camming slots 32 are placed about the entire circumference of opening 20. Therefore, no matter the initial orientation of pin 2, an outside surface of lance I2 will eventually engage a respective camming surface 34 of camming slot 32. Consequently, as insertion continues, lance 12 will be forced along camming surface 34 until lance 12 is positioned in alignment with a respective slot 28.

To insure that stubbing of lance 12 on camming surfaces 34 does not occur, the intersection of various camming surfaces 34 are configured in a point shape. Consequently, as lance 12 engages an end of a respective camming surface 34, the point of lance 12 will cooperate with the point of camming surfaces 34 to provide for a smooth insertion, i.e. with no stubbing.

In the embodiment shown in the figures, four identical camming slots 32 are provided in a circumferential manner about the surface of opening 20. With four equal camming slots 32 provided, the maximum amount that pin 2 will rotate during insertion is 45 degrees. This maximum rotation occurs when, upon insertion, the point of lance 12 engages the point 36 of respective Camming surfaces 34. As insertion continues, lance 12 will be forced along a respective camming surface 34, which will cause a total rotation of pin 2 which is equivalent to 45 degrees. If the point of lance 12 initially engages camming surface 34 at any other spot, the rotation of pin 12 will be less then 45 degress.

The maximum rotation of pin 2 will vary according to the number of camming slots 32 provided. For example, if three equal slots 34 are provided, the maximum rotation will be 60 degrees, if five slots are provided the maximum rotation will be 36 degrees, etc.

The number of camming slots 32 provided around the circumference of opening 20 depends upon the amount of rotation of pin 2 which is acceptable. The finer, more fragile wires demand the use of a pin and socket which essentially prevents rotation, as rotation causes stresses on the wire resulting in a failure of the wire. Consequently, as the strength of the wire decreases, the number of camming slots 32 must be increased in order to prevent the failure of the wire.

As was previously described, as pin 2 is inserted into socket 4, lance 12 is forced to align with slots 28, as is shown in FIG. 3. As insertion continues camming surfaces 34 force ends 14 of lance 12 to resiliently deflect in the direction indicated by the arrows in FIG. 3. As lance 12 moves past camming surfaces 34, ends 14 of lance 12 resiliently return to their original, unstressed position. When this occurs, shoulders 30 cooperate with ends 14 of lance 12 to prevent lance 12, and pin 2, from being moved backward along the axis of insertion.

Subsequent to lance 12 moving past camming surfaces 34, projection 19 of pin 2 engages points 36 of camming surfaces 34. This prevents further insertion of pin 2 into socket 4. This occurs quickly after lance 12 is moved past camming surfaces 34.

In the fully inserted position, as shown in FIG. 4, pin 2 is locked in position with respect to socket 4. Projections 19 cooperate with points 36 and ends 14 of lance 12 cooperate with shoulders 30 to prevent pin 2 from movement along the axis of insertion. Lance 12 also cooperates with side surfaces of slot 28 to prevent rotational movement of pin 2 relative to socket 4. Consequently, pin 2 is securely maintained in position relative to socket 4 when pin 2 is fully inserted therein.

Pin 2 may be moved from socket 4 by an extraction tool which is inserted into a respective slot 28. The tool resiliently moves ends I4 of lance 12 inward, allowing lance 12 and pin 2 to be removed along the axis of insertion. The tool is then removed and ends 14 of lance 12 are returned to their unstressed position.

It is obvious from the above description that the invention presented herein is useful for pin and sockets in which fine wire is utilized. It should also be noted that the invention is of benefit in applications in which fine wire is not used. The principals of the invention are not dependent upon the use of fine wire, but rather the invention is of benefit when it is necessary to securely hold the pin in place relative to the socket.

As can be discerned, there has been disclosed novel pin and socket terminals which prevent the rotation of the pins relative to the sockets. The sockets also insure that the pins will not move relative to the sockets after the pins have been fully inserted therein.

Changes in construction will occur to those skilled in the art and various apparently different modifications and embodiments may be made without departing from the scope of the invention. The matter set forth in the foregoing description and accompanying drawings is offered by way of illustration only.

I claim:

1. An electrical connector for use with a pin contact, the electrical connector comprising an electrical terminal and a dielectric housing, the terminal having a contact engaging section for electrical engagement with the pin contact, the dielectric housing provided with a contact receiving cavity extending therethrough to a mating surface of the dielectric housing, the terminal being positioned in a portion of the contact receiving cavity, the electrical connector being characterized in that:

the cavity has lead-in and securing surfaces extending radially inwardly proximate the mating surface, the surfaces being spaced apart and separated by a plurality of camming slots and securing slots which are symmetrically positioned about the circumference of the cavity, the cavity being adapted to receive a pin contact having means which are cooperable with the camming slots to prevent over rotation of the pin contact during insertion into the contact receiving cavity, the pin contact means also cooperating with the securing slots to prevent any type of movement of the pin contact after the pin contact has been fully inserted into the contact receiving cavity.

2. An electrical connector as set forth in claim 1 characterized in that the contact receiving cavity has an enlarged diameter proximate the mating surface, such that as the pin contact is inserted therein, the enlarged diameter acts as a guide in surface, thereby compensating for damaged or misinserted pin contacts.

3. An electrical connector as set forth in claim 1 characterized in that the contact receiving cavity has a first portion and a second portion, the first portion is positioned proximate the mating surface and contains the lead-in and securing surfaces, the second portion is adjacent the first portion and houses the terminal.

4. An electrical connector as set forth in claim 3 characterized in that the lead-in and securing surfaces are molded from the dielectric housing.

5. An electrical connector as set forth in claim 4 characterized in that the camming slots are positioned about the circumference of the cavity, each camming slot having a wide opening proximate the mating surface and a narrower opening proximate the securing slot which is proximate the second portion of the cavity, the side walls of the slots acting as camming surfaces.

6. An electrical connector as set forth in claim 5 characterized in that a plurality of identical camming slots are provided about the circumference of the cavity, the camming slots being spaced such that the a respective camming surface of one camming slot intersects a respective camming surface of another camming slot to form a point therebetween.

7. An electrical connector as set forth in claim 6 characterized in that a respective securing slot is provided adjacent to the narrow portion of each camming slot, such that the longitudinal axis of the respective securing slot is in the same line as the longitudinal axis of the camming slot to which it is adjacent.

8. An electrical connector as set forth in claim 7 characterized in that shoulders are provided at the end of the securing slots which is adjacent the camming slots, as the width of the securing slots is greater than the width of the narrow portion of the camming slots.

9. An electrical connector as set forth in claim 8 characterized in that pin contact means has a resilient lance which projects from a surface of the pin contact, the lance cooperating with the camming surfaces as the pin contact is inserted into the contact receiving cavity, thereby controlling the rotation of the lance and the pin contact during the insertion of the pin contact into the electrical connector.

10. An electrical connector as set forth in claim 9 characterized in that the pin contact has a shoulder which projects from the surface of the pin contact, such that as the pin contact is inserted into the electrical connector, the lance is resiliently deformed as is is forced through the narrow portion of the camming slots, the lance resiliently returning to the unstressed position as the lance is moved into the securing slot, at which time the shoulders of the pin contact engage the points formed by the intersection of the camming surfaces, the cooperation of the lance with the shoulders of the securing slots and the cooperation of the shoulders of the pin contact with the points of the electrical connector prevents the movement of the pin contact with respect to the electrical connector.

* * * * *